US009388619B2

(12) United States Patent
Park et al.

(10) Patent No.: US 9,388,619 B2
(45) Date of Patent: Jul. 12, 2016

(54) AUTOMATIC CLOSING APPARATUS

(71) Applicants: SEGOS CO., LTD., Incheon (KR); Yoon Sig Park, Seoul (KR)

(72) Inventors: Yoon Sig Park, Seoul (KR); Hyun ho Cha, Gyeonggi-do (KR)

(73) Assignees: SEGOS CO., LTD., Icheon (KR); Yoon Sig Park, Seoul (KR)

( * ) Notice: Subject to any disclaimer, the term of this patent is extended or adjusted under 35 U.S.C. 154(b) by 0 days.

(21) Appl. No.: 14/414,433

(22) PCT Filed: Jul. 12, 2013

(86) PCT No.: PCT/KR2013/006238
§ 371 (c)(1),
(2) Date: Jan. 12, 2015

(87) PCT Pub. No.: WO2014/010980
PCT Pub. Date: Jan. 16, 2014

(65) Prior Publication Data

US 2015/0204129 A1 Jul. 23, 2015

(30) Foreign Application Priority Data

Jul. 12, 2012 (KR) ..... 10-2012-0076177
Aug. 23, 2012 (KR) ..... 10-2012-0092471

(51) Int. Cl.
*E05F 1/08* (2006.01)
*E05F 3/10* (2006.01)
(Continued)

(52) U.S. Cl.
CPC ..... *E05F 3/108* (2013.01); *A47B 88/047* (2013.01); *E05F 1/16* (2013.01); *E05F 3/02* (2013.01);
(Continued)

(58) Field of Classification Search
CPC ..... E05F 5/003; E05F 5/05; E05F 1/08; E05F 1/1091; E05F 1/16; E05F 3/00; E05F 3/02; E05F 3/04; E05F 3/18; E05F 3/227; E05F 3/22; E05F 3/10; E05F 3/108; E05Y 2800/24; E05Y 2800/21; E05Y 2201/64; E05Y 2201/644; E05Y 2201/264; E05Y 2201/41; E05Y 2201/412; E05Y 2201/47; E05Y 2201/21; E05Y 2201/488; E05Y 2900/132; E05Y 2900/142; E05Y 2900/14; Y10T 16/27; Y10T 16/56; Y10T 16/61; Y10T 16/593; Y10T 16/276; Y10T 16/281; Y10T 16/379; E05D 15/00; E05D 15/06; E05D 15/12; A47B 88/047; A47B 88/12; A47B 88/14; A47B 2210/0091
See application file for complete search history.

(56) References Cited

U.S. PATENT DOCUMENTS

2004/0237252 A1* 12/2004 Hoshide ..... A47B 88/047 16/72
2008/0284299 A1* 11/2008 Chen ..... A47B 88/04 312/332
(Continued)

FOREIGN PATENT DOCUMENTS

ES 2546444 A2 * 1/2013 ..... E05F 5/003
JP 2002-286076 A 10/2002
(Continued)

OTHER PUBLICATIONS

International Search Report for PCT/KR2013/006238.

*Primary Examiner* — Chuck Mah
(74) *Attorney, Agent, or Firm* — The PL Law Group, PLLC

(57) ABSTRACT

Disclosed herein is an automatic closing apparatus for a sliding apparatus. The sliding apparatus comprises a fixed rail, a movable rail, and the automatic closing apparatus. The automatic closing apparatus includes a body, a slider, a housing, a damping unit, and an elastic body. The body is provided on the fixed rail and has an actuating space therein. The body includes: a guide wall that is provided in the actuating space and includes a curved guide part and a linear guide part; and a receiving space formed adjacent to the curved guide part. The slider is locked to or unlocked from a locking member of the movable rail and slides in an open or close direction under guide of the guide wall. The housing is coupled to the body. The damping unit is installed in the housing. The elastic body is fastened to the housing and the slider.

5 Claims, 8 Drawing Sheets

(51) Int. Cl.

| | |
|---|---|
| ***A47B 88/04*** | (2006.01) |
| ***E05F 5/00*** | (2006.01) |
| ***E05F 1/16*** | (2006.01) |
| ***E05F 3/02*** | (2006.01) |

(52) U.S. Cl.

CPC ..... *E05F 5/003* (2013.01); *A47B 2210/0091* (2013.01); *A47B 2210/175* (2013.01); *E05Y 2201/212* (2013.01); *E05Y 2201/41* (2013.01); *E05Y 2201/412* (2013.01); *E05Y 2800/24* (2013.01); *E05Y 2900/20* (2013.01); *Y10T 16/276* (2015.01); *Y10T 16/281* (2015.01)

(56) References Cited

U.S. PATENT DOCUMENTS

| | | | | |
|---|---|---|---|---|
| 2010/0123378 | A1* | 5/2010 | Chen | A47B 88/047 312/333 |
| 2011/0023370 | A1* | 2/2011 | Zimmer | E05F 1/16 49/360 |
| 2011/0167588 | A1* | 7/2011 | Chang | E05F 5/003 16/71 |
| 2011/0215690 | A1* | 9/2011 | Juan | A47B 88/12 312/319.1 |
| 2013/0076219 | A1* | 3/2013 | Lam | A47B 88/047 312/319.1 |
| 2013/0091665 | A1* | 4/2013 | Tsai | E05F 3/18 16/49 |
| 2013/0104339 | A1* | 5/2013 | Shimizu | A47B 88/047 16/72 |
| 2013/0133157 | A1* | 5/2013 | Kimura | A47B 88/047 16/49 |
| 2013/0182978 | A1* | 7/2013 | Huang | A47B 88/047 384/21 |
| 2014/0026357 | A1* | 1/2014 | Zimmer | E05F 1/16 16/72 |
| 2014/0109343 | A1* | 4/2014 | Chang | E05F 5/003 16/49 |

FOREIGN PATENT DOCUMENTS

| | | | | |
|---|---|---|---|---|
| JP | WO 2006011294 | A1 * | 2/2006 | E05F 1/16 |
| JP | 2006063767 | A * | 3/2006 | |
| JP | 2008223456 | A * | 9/2008 | |
| JP | 2009203782 | A * | 9/2009 | |
| JP | 4436154 | B2 | 3/2010 | |
| KR | 100937158 | B1 * | 1/2010 | |
| KR | 10-2011-0081738 | A | 7/2011 | |
| KR | 10-2012-0002183 | A | 1/2012 | |
| KR | 101180141 | B1 * | 9/2012 | |

* cited by examiner

AUTOMATIC CLOSING APPARATUS

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/KR2013/006238, filed Jul. 12, 2013, which claims priority to Korean Patent Application Nos. 10-2012-0076177, filed Jul. 12, 2012, and 10-2012-0092471, file Aug. 23, 2012, the entire contents of which are incorporated herein by reference.

TECHNICAL FIELD

The present invention generally relates to automatic closing apparatuses. More particularly, the present invention relates to an automatic closing apparatus that includes: a housing coupled to a body installed on each of fixed rails provided on opposite side surfaces of a container; and a damping unit inserted into the housing rearward and configured such that during a process of closing the container, when an outer surface of a rear end of a damper comes into contact with an inner surface of a rear end of the housing, the damping unit begins to absorb shock so that the container can be slowly moved in the close direction, whereby the container or objects stored in the container can be prevented from being deformed or damaged by a shock generated during the closing operation of the container, and even when force by which the container is closed is equal to or larger than the critical load, the container can be prevented from rebounding in the open direction.

BACKGROUND ART

Generally, sliding containers are provided in main bodies, for example, of furniture, refrigerators, a variety of storage cabinets, etc., in such a way that the sliding containers can be retractably pulled out of the main bodies in a sliding manner to enable objects to be stored in the containers.

Such a sliding container can be opened or closed by a sliding apparatus. In detail, space for installation of the container is formed in the main body. Parts of the sliding apparatus are respectively provided on inner side surfaces of the installation space and outer side surfaces of the container and are configured so as to be slidable relative to each other by means of rolling contact. For instance, when a user applies force to the container in a close direction, the container is inserted into the space of the main body by the sliding operation of the sliding apparatus and thus is closed. However, if a force excessively greater than force required to close the container is applied to the container, the container may be undesirably re-opened by repulsive force that is generated by collision between the parts of the sliding apparatus when the container is closed.

To overcome the above-mentioned problem, various kinds of automatic closing apparatuses configured such that a container can be automatically closed by elastic force have been introduced.

As a representative example of apparatuses for automatically closing such sliding containers, an under-mounting sliding apparatus was proposed in Korean Patent Registration No. 10-1114478, filed by the applicant of the present invention. The sliding apparatus of 10-1114478 includes: a housing body that is provided on a portion of a fixed rail and has therein a housing space which is open on upper and lower ends thereof; a guide wall that includes a curved guide part and a linear guide part disposed in the housing space formed in the housing body; a slider that is configured to be locked to or unlocked from a locking member of a movable rail and is guided by a guide wall; and an elastic body elastically coupled to the slider. However, the apparatus of 10-1114478 is problematic in that the container or objects stored in the container may be deformed or damaged by a shock generated when the container is moved in the close direction and then closed.

SUMMARY

Accordingly, the present invention has been made keeping in mind the above problems occurring in the prior art, and an object of the present invention is to provide an automatic closing apparatus that includes: a housing coupled a body installed on each of fixed rails provided on opposite side surfaces of a container; and a damping unit inserted into the housing rearward and configured such that during a process of closing the container, when an outer surface of a rear end of a damper comes into contact with an inner surface of a rear end of the housing, the damping unit begins to absorb shock so that the container can be slowly moved in the close direction, whereby the container or objects stored in the container can be prevented from being deformed or damaged by a shock generated during the closing operation of the container, and even when force by which the container is closed is equal to or larger than the critical load, the container can be prevented from rebounding in the open direction.

In order to accomplish the above object, the present invention provides an automatic closing apparatus for a sliding apparatus comprising a fixed rail fastened to a main body, a movable rail slidably installed on the fixed rail so that a container is opened or closed, and the automatic closing apparatus provided on a predetermined portion of the fixed rail. The automatic closing apparatus includes: a body provided on the predetermined portion of the fixed rail, with an actuating space formed in the body to be open on upper and lower ends thereof, the body having a guide wall provided in the actuating space, the guide wall including a curved guide part and a linear guide part, and a receiving space formed adjacent to the curved guide part; a slider configured to be locked to or unlocked from a locking member of the movable rail, the slider sliding in an open or close direction under guide of the guide wall; a hollow housing coupled to a predetermined portion of the body; a damping unit installed in the housing; and an elastic body fastened at a first end thereof to the housing and fastened at a second end thereof to the slider.

The damping unit may include: a damper inserted into the housing rearward and provided so as to slidable within a predetermined range in the housing, the damper having therein a hollow receiving space having a predetermined size; and a damping member having a shock absorption part provided in the damper so as to be slidable in a longitudinal direction of the damper, and a damper rod fastened at an end thereof to the shock absorption part and extending in the longitudinal direction, the damper rod being configured such that as the shock absorption part slides, the damper rod is extended from and retracted into the damper. During a process of closing the container, when an outer surface of a rear end of the damper comes into contact with an inner surface of a rear end of the housing, the damping unit may begin to absorb shock so that the container is slowly moved in a close direction by restoring force of the elastic body.

The damper may be configured so as to be replaceable with a damper having a different length, wherein shock absorption performance of the sliding apparatus can be adjusted by installing any one of the dampers having different lengths in the housing.

Working fluid may be contained in the receiving space. The working fluid may comprise either gas or liquefied oil that can resist compressive force.

The damping unit may further include a connector hinged to an end of the damper rod so as to be rotatable within a predetermined radius range.

A frictional force between the damper and the housing may be less than a frictional force between the damper and the damping member.

An automatic closing apparatus according to the present invention includes: a housing coupled a body installed on each of fixed rails provided on opposite side surfaces of a container; and a damping unit inserted into the housing rearward and configured such that during a process of closing the container, when an outer surface of a rear end of a damper comes into contact with an inner surface of a rear end of the housing, the damping unit begins to absorb shock so that the container can be slowly moved in the close direction. Thereby, the container or objects stored in the container can be prevented from being deformed or damaged by a shock generated during the closing operation of the container. Even when force by which the container is closed is equal to or larger than a critical load, the container can be prevented from rebounding in the open direction.

DETAILED DESCRIPTION

Figure 1:
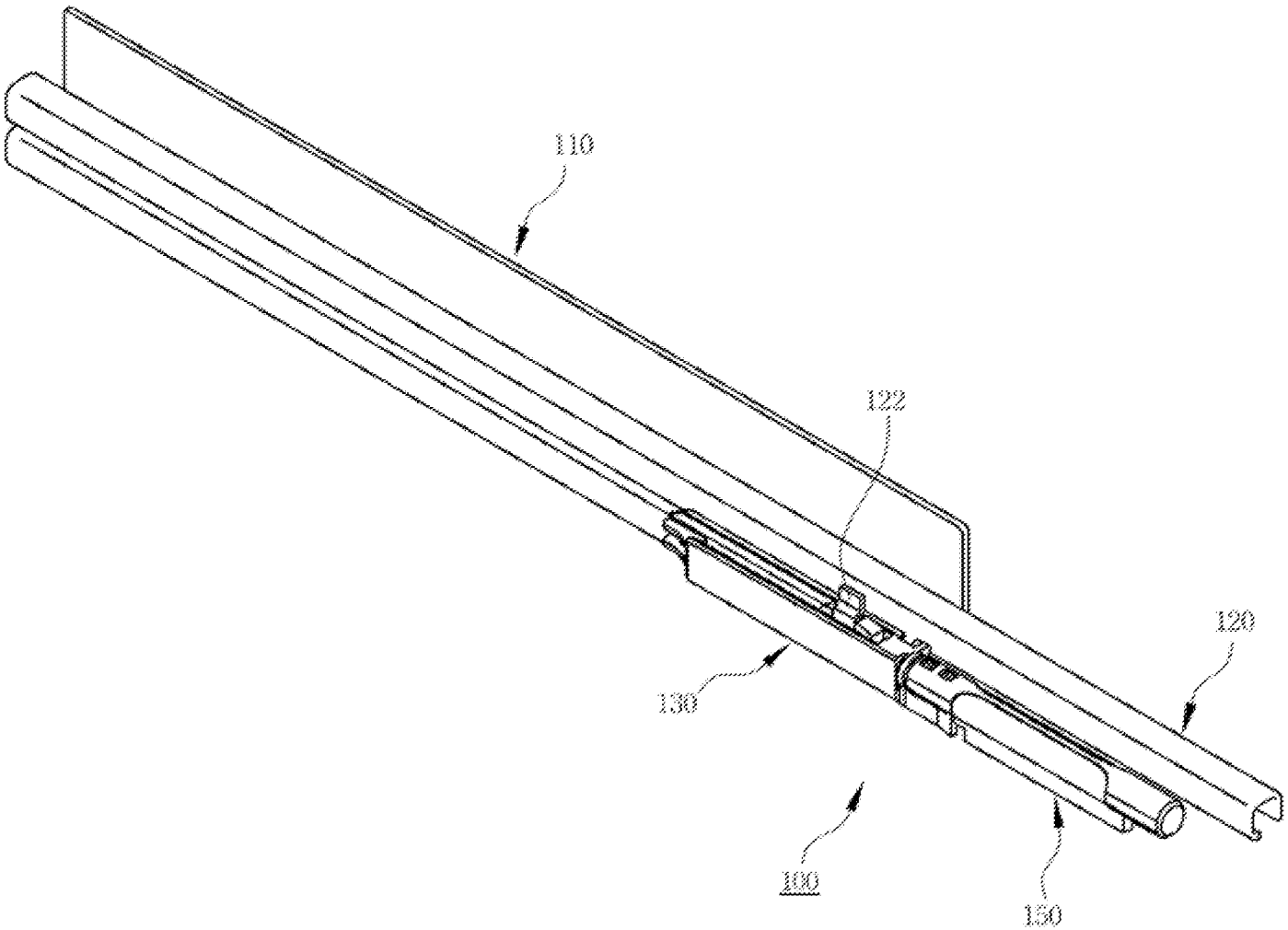
FIG. 1 is a perspective view illustrating a sliding apparatus provided with an automatic closing apparatus according to the present invention.
Figure 2:
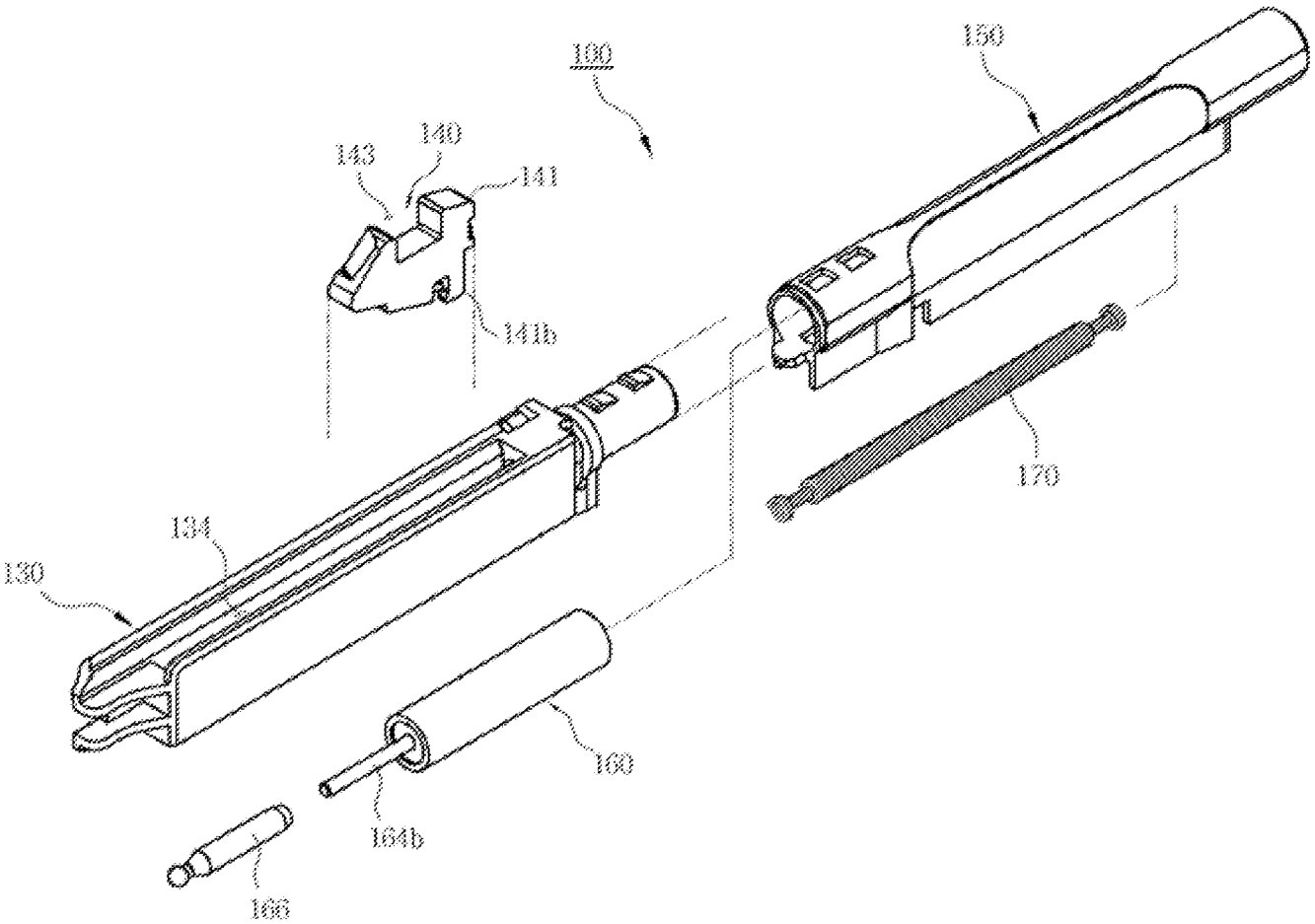
FIG. 2 is an exploded perspective view illustrating the sliding apparatus according to the present invention.
Figure 3:
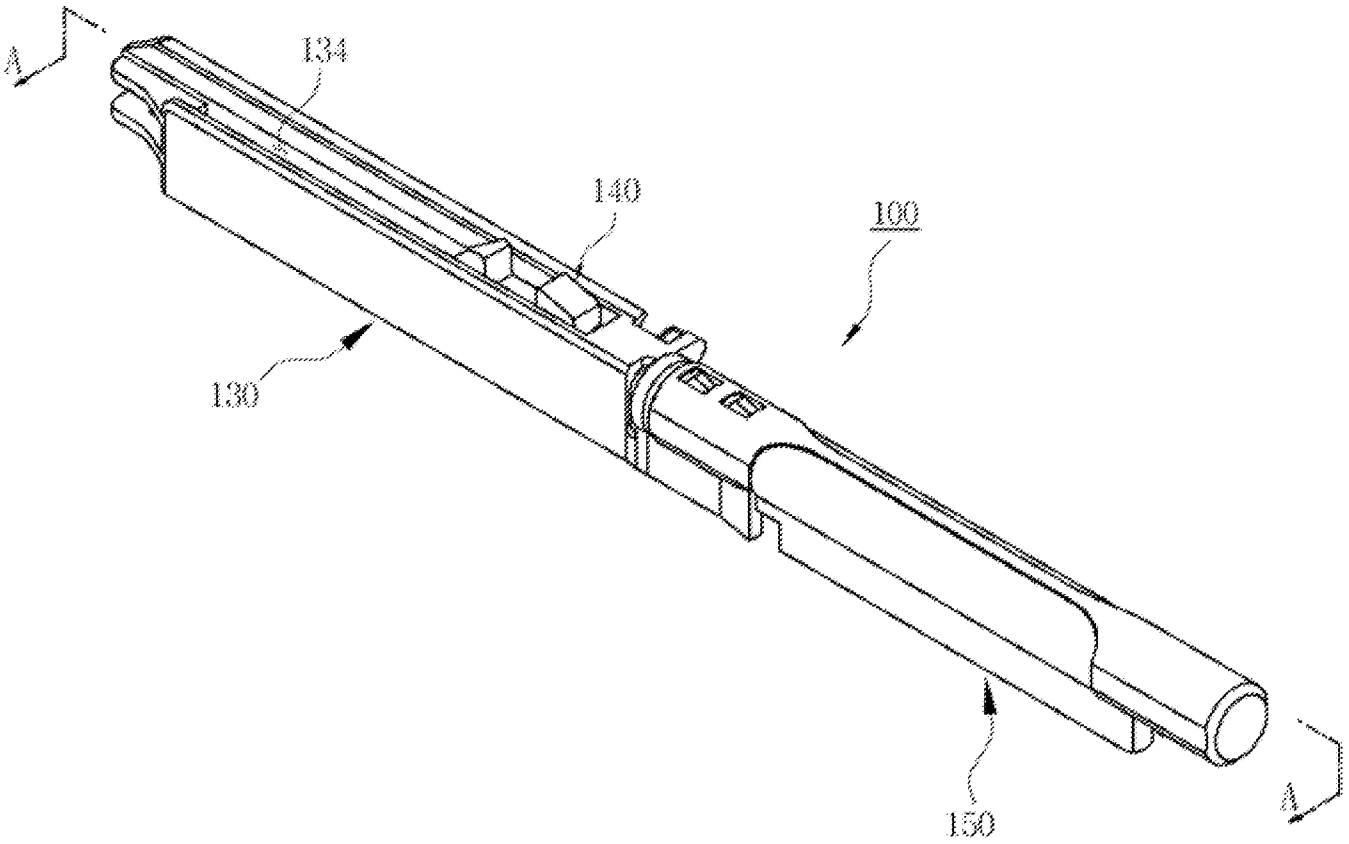
FIG. 3 is a perspective view illustrating the sliding apparatus according to the present invention.
Figure 4:
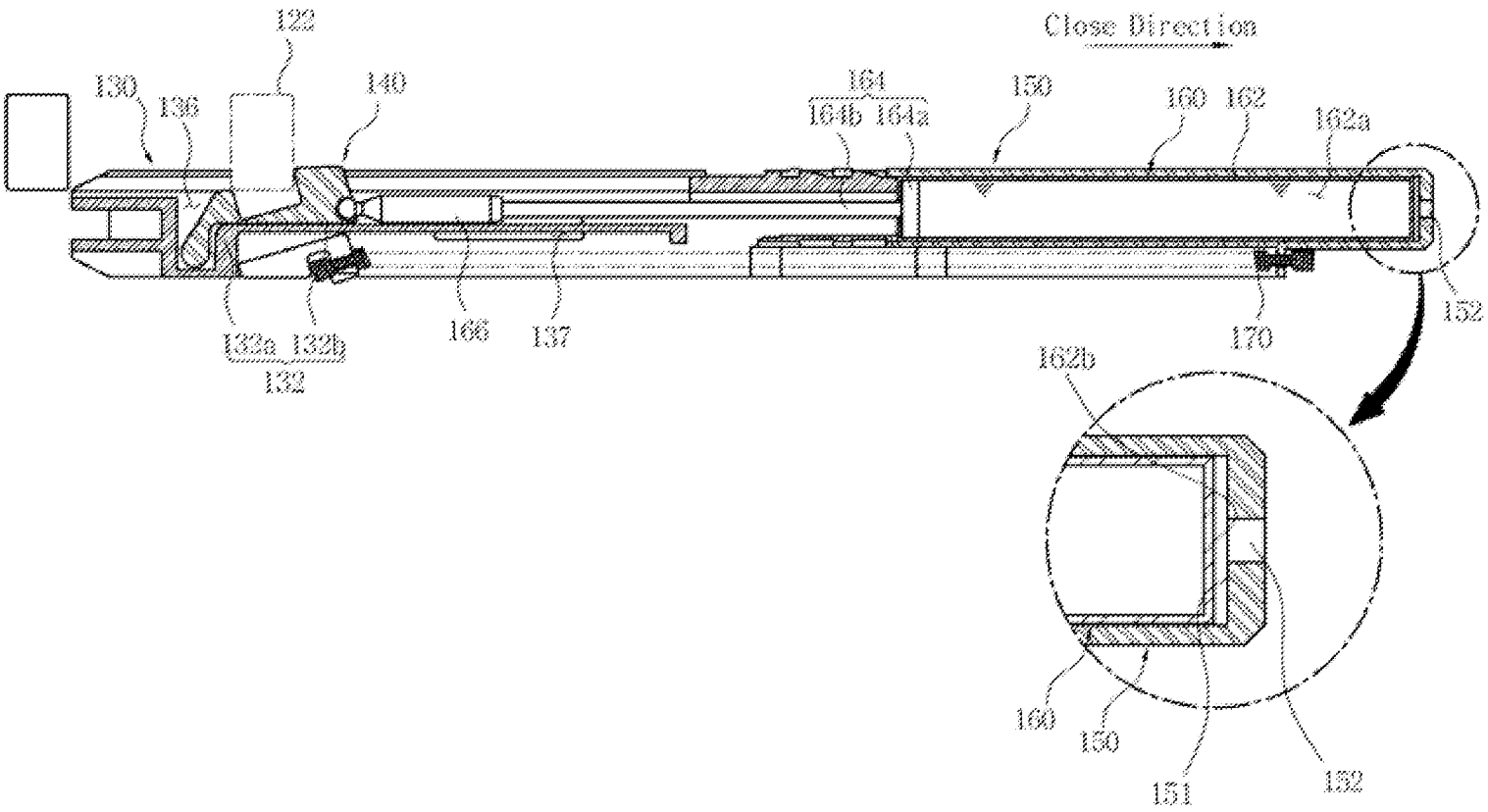
FIG. 4 is a sectional view taken along line 'A-A' so as to show a slider received in a receiving space of a body when a closing operation starts.
Figure 5:
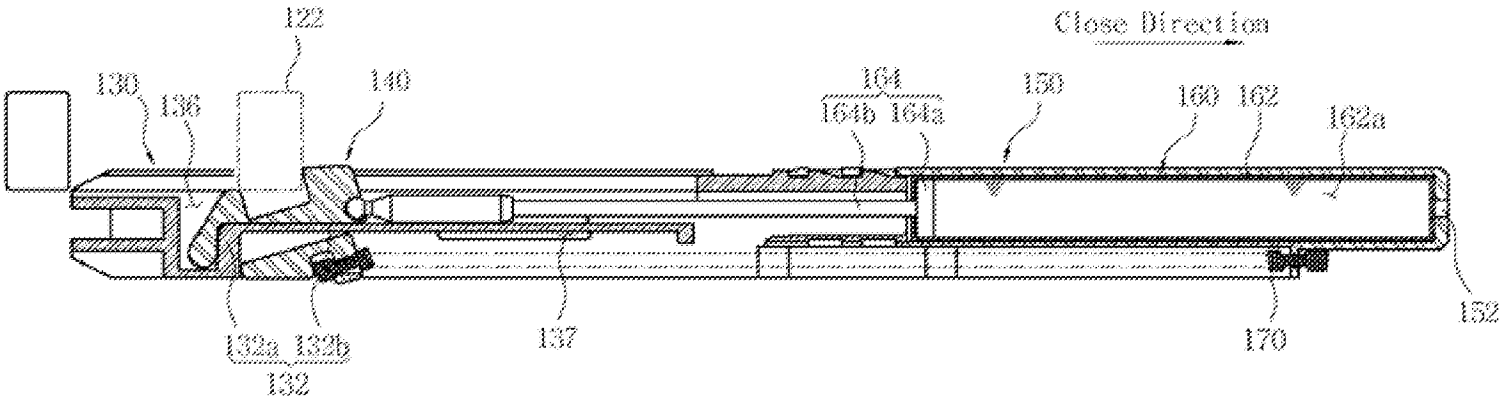
FIG. 5 is a sectional view illustrating a damper moved toward a rear end of a housing from the state of FIG. 4.
Figure 6:
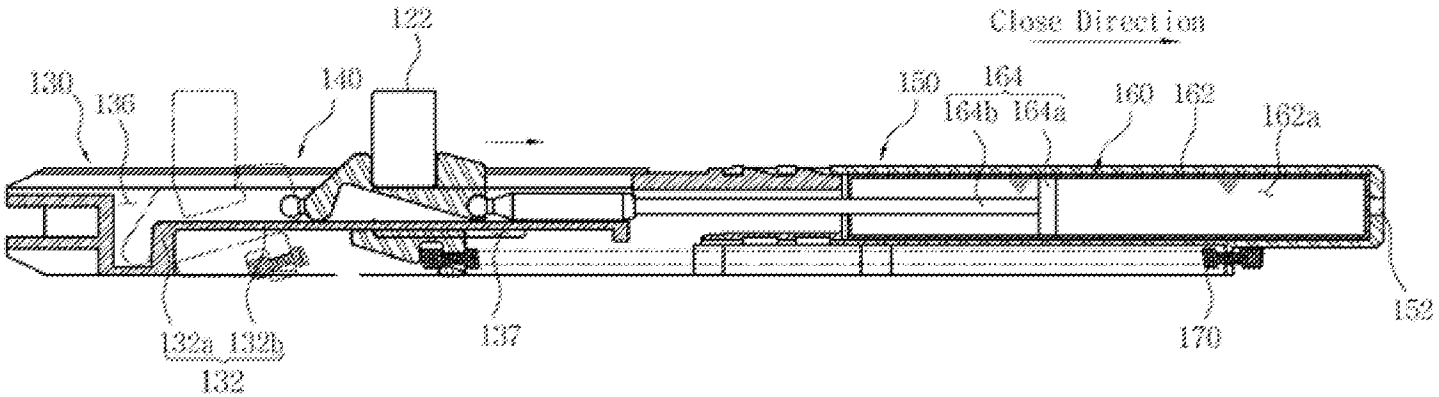
FIG. 6 is a sectional view showing a start of the shock absorption operation by means of bringing an outer surface of a rear end of the damper into contact with the inner surface of the rear end of the housing from the state of FIG. 5.
Figure 7:
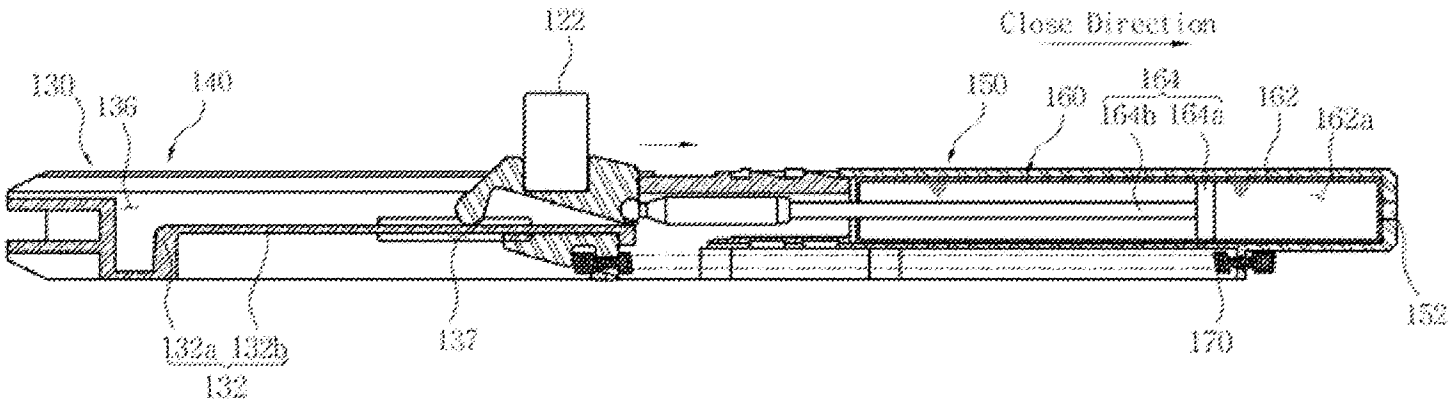
FIG. 7 is a sectional view showing the slider that slides in the close direction from the state of FIG. 6 while the shock absorption operation is conducted.
Figure 8:
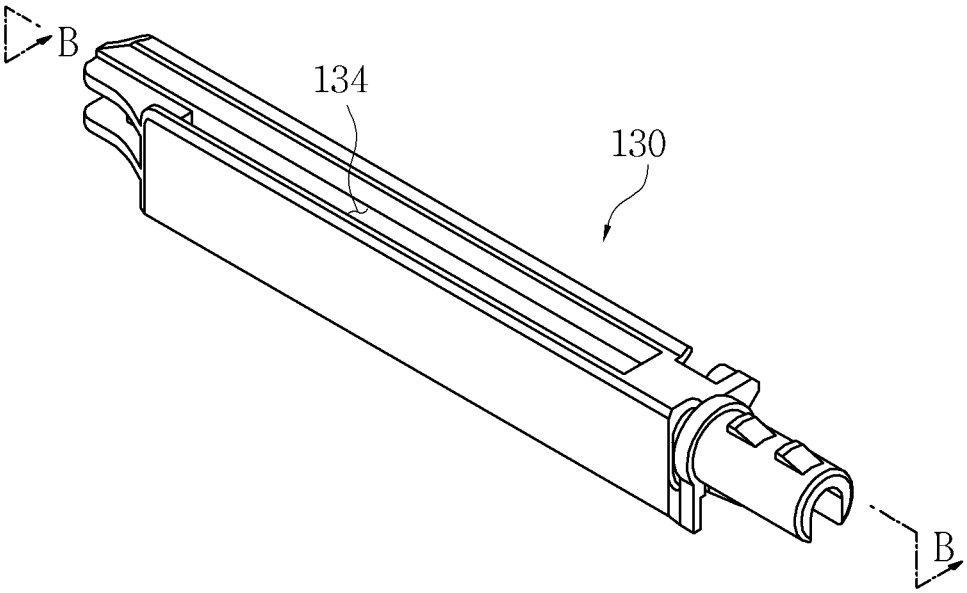
FIG. 8 is a perspective view illustrating the body according to the present invention.
Figure 9:
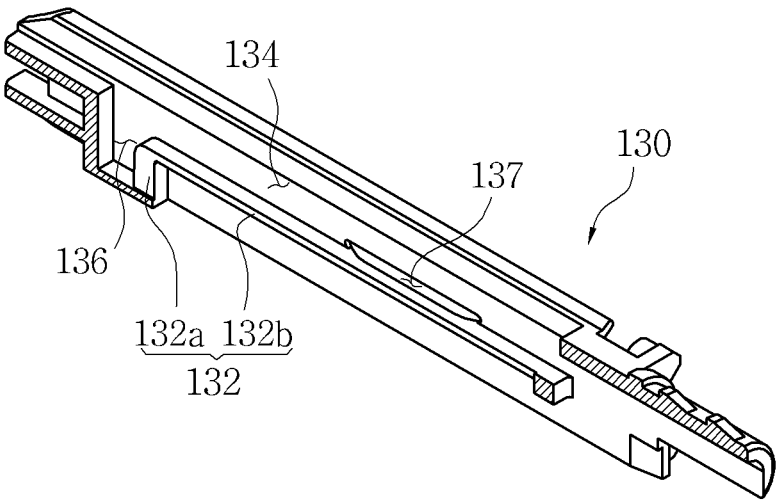
FIG. 9 is a sectional view taken along line 'B-B' of FIG. 8.
Figure 10:
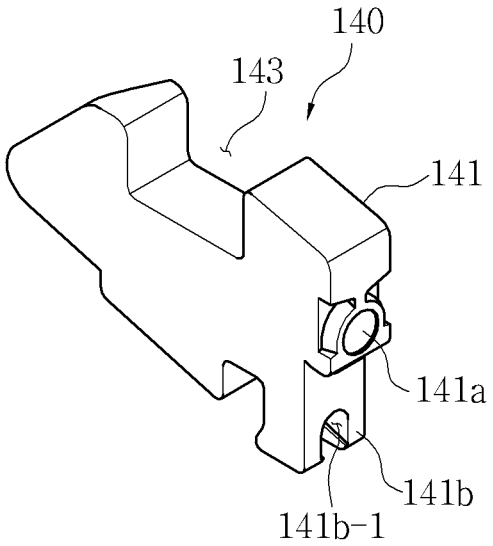
FIG. 10 is a perspective view illustrating the slider according to the present invention.
Figure 11:
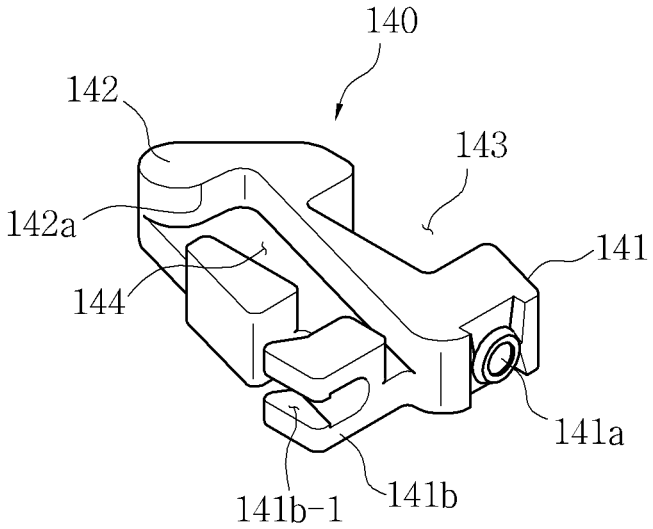
FIG. 11 is a perspective view showing the slider of FIG. 10 from a different direction.

Hereinafter, an embodiment of the present invention will be described in detail with reference to the attached drawings, such that those skilled in the art can easily implement the present invention. The present invention may be realized in various manners and is not limited to the following embodiment. Reference should be made to the drawings, in which similar reference numerals are used throughout the different drawings to designate similar components.

A sliding apparatus 100 according to the present invention includes: a fixed rail 110 fixed to a main body (not shown); a movable rail 120 that is slidably installed on the fixed rail 110 so as to enable a container (not show) to be opened and closed; and an automatic closing apparatus provided on a predetermined portion of the fixed rail 11. The automatic closing apparatus includes: a body 130 provided on a predetermined portion of the fixed rail 110; a slider 140 that is locked to or unlocked from a locking member 122 of the movable rail 120 and is moved along a guide wall 132 formed on an inner surface of the body 130; a housing 150 coupled to an end of the body 130; a damping unit 160 provided in the housing 150; and an elastic body 170 provided between the housing 150 and the slider 140.

The fixed rail 110 is fixed to each of opposite inner sidewalls of the main body, for example, of furniture, a refrigerator, a variety of storage cabinets, etc., in which a container is installed. The fixed rail 110 functions to support the container while enabling the container to slide.

The movable rail 120 is coupled to each of the opposite side surfaces of a lower portion of the container and is slidably provided on the fixed rail 110. Thus, the movable rail 120 along with the container slides in the longitudinal direction thereof. A locking member 122 is provided at a predetermined position on the movable rail 120. When the container is opened or closed, the locking member 122 is locked to or unlocked from a locking depression 143 formed in the slider 140.

The body 130 is installed on a predetermined portion of the fixed rail 110 that is fixed to the inner surface of the main body. A guide wall 132 is provided on an inner surface of the body 130. The guide wall 132 includes a curved guide part 132*a* provided on an opening-direction end of the guide wall 132, and a linear guide part 132*b* extending from the curved guide part 132*a*. The curved guide part 132*a* is disposed on the opening-direction end of the guide wall 132 and has a downward-curved structure. The linear guide part 132*b* linearly extends in the longitudinal direction from the curved guide part 132*a*. Including the curved guide part 132*a* and the linear guide part 132*b*, the guide wall 132 is inserted into the slider 140 so as to guide the movement of the slider 140.

An actuating space 134 is formed in the body 130 such that upper and lower surfaces of the body 130 are open. In addition, a receiving space 136 is formed in the body 130 so that the rotational locking protrusion 142 of the slider 140 is disposed in the receiving space 136. Communicating with the actuating space 134, the through hole 137 is formed in the actuating space 134. The slider 140 is installed in the actuating space 134 so as to be movable in the longitudinal direction. The linear guide part 132*b* can be elastically deformed inside the through hole 137 by external force.

For example, if the slider 140 that is moving along the guide wall 132 malfunctions, the movable rail 120 is forcibly moved to a closed position. The slider 140 that is locked to the locking member 122 and moved by the forcible movement of the movable rail 120 makes the guide wall 132 be elastically deformed adjacent to the through hole 137 by applied external force. After the guide wall 132 is elastically deformed, when the locking member 122 is inserted into the locking depression 143 and the guide wall 132 that has been elastically deformed is returned to its original state, the slider 140 that has been displaced from the operating position by the malfunction can be normally operated.

The receiving space 136 of the body 130 functions to receive the rotational locking protrusion 142 of the slider 140 moved toward the curved guide part 132*a* provided in the body 130.

Disposed in the actuating space 134 of the body 130, the slider 140 is locked to or unlocked from the locking depression 143 of the movable rail 120. Furthermore, the slider 140 is guided along the guide wall 132 and moved in the open direction or the close direction.

The slider 140 includes: a locking rotation block 141 that is disposed in the actuating space 134 and has in a first end thereof a connector locking depression 141*a* and an elastic-body locking protrusion 141*b*; a rotational locking protrusion 142 provided on a second end of the locking rotation block 141; a locking depression 143 that is formed in an upper end of the locking rotation block 141 so that the locking member 122 is locked to or unlocked from the slider 140 through the locking depression 143; and a guide insert depression 144 that is open toward the fixed rail 110, and into which the guide wall 132 is inserted.

The connector locking depression 141*a* is fitted, so as to be rotatable with a predetermined radius, over a connector 166 coupled to an end of a damper rod 164*b* provided on a damper 162.

An elastic-body locking slot 141*b*-1 for use in installation of the elastic body 170 is formed in the elastic-body locking protrusion 141*b*. The elastic-body locking protrusion 141*b* is provided under a lower end of a close-directional end of the slider 140 and is pulled in the close direction by the elastic force of the elastic body 170. The center point of the slider 140 fitted over the guide wall 132 is located at a position higher than a point to which the elastic force of the elastic body 170 is applied. Because of such different center points, an open-directional end of the slider 140 is rotated downward.

When the container is moved in the open direction, the slider 140 is moved along with the locking member 122 in the open direction while the locking member 122 inserted into the locking depression 143 is moved in the open direction. After the slider 140 that is moved in the open direction reaches the curved guide part 132*a* of the guide wall 132, the slider 140 is rotated along the curved guide part 132*a*, and the rotational locking protrusion 142 is then inserted into the receiving space 136. Here, while the locking depression 143 is rotated downward, the locking member 122 is unlocked from the locking depression 143 so that the locking member 122 can be further moved in the open direction. Thereby, the movable rail 120 can be moved in the open direction.

When the container is closed, the locking member 122 is moved in the close direction and locked to the locking depression 143 of the slider 140. When the locking member 122 is further moved in the close direction, the rotational locking protrusion 142 that has been inserted into the receiving space 136 is moved from the curved guide part 132*a* of the guide wall 132 to the linear guide part 132*b*, and the locking depression 143 that has been inclined is rotated upward. Consequently, the locking member 122 is inserted into the locking depression 143.

Due to the above-mentioned construction, when the container is moved in the open direction, the slider 140 is guided toward the linear guide part 132*b* of the guide wall 132 and located on the curved guide part 132*a*. While the slider 140 is rotated, a curved contact surface 142*a* of the slider 140 is brought into contact with the curved guide part 132*a* and is locked thereto. Furthermore, when the container is moved in the close direction, the locking member 122 is locked to the locking depression 143 and moves the slider 140 in the close direction, whereby the slider 140 that has been in the locked state is released. The released slider 140 is automatically moved in the close direction by the restoring force of the elastic body 170.

The housing 150 is coupled to the end of the body 130 and has a hollow structure. An end of the housing 150 that corresponds to the body 130 is open. A shock absorption hole 152 is longitudinally formed in a rear end of the housing 150. Thus, when the damper 162 is moved rearward in the housing 150, the pressure in the housing 150 is relieved through the shock absorption hole 152 so that the movement of the damper 162 can be facilitated.

The cross section of the housing 150 that is perpendicular to the longitudinal direction in which the damper 162 slides has a closed curve shape so that the damper 162 can slide in the housing 150 only in the longitudinal direction and be prevented from buckling or being removed in a direction other than the longitudinal direction, in which the damper 162 slides, due to a shock generated when the container is closed.

The damping unit 160 is inserted into the housing 150 through the opening of the housing 150 and disposed in the rear end of the housing 150.

The damping unit 160 includes the damper 162 and a damping member 164. The damper 162 is disposed in the housing 150. The damping member 164 includes a shock absorption part 164*a* disposed in the damper 162 so as to be slidable in the longitudinal direction, and a damper rod 164*b* longitudinally fastened to the shock absorption part 164*a*.

Disposed in the housing 150, the damper 162 is provided so as to be movable within a predetermined range in the housing 150. The damper 162 has therein a receiving space 162*a* of a predetermined size to form a hollow structure. Working fluid comprising either gas or liquefied oil that can resist compressive force is contained in the receiving space 162*a*. The damper 162 is changed in length so that a shock absorption section can be adjusted by changing the length of the damper 162 that is installed in the housing 150.

The shock absorption part 164*a* of the damping member 164 has a smaller outer diameter than an inner diameter of the damper 162. The shock absorption part 164*a* is disposed in the damper 162 so as to be slidable in the longitudinal direction.

The damper rod 164*b* extends a predetermined length in the longitudinal direction and is fastened at a first end thereof to the shock absorption part 164*a*. The connector 166 is hinged to a second end of the damper rod 164*b* so as to be rotatable within a predetermined radius range.

The damping unit 160 according to the present invention has a one-way structure configured such that the damping operation is not conducted in the open direction. When an outer surface of a rear end 162*b* of the damper comes into contact with an inner surface of a rear end 151 of the housing during the operation of closing the container, the damping operation starts so that the container slowly moves in the close direction.

When the container is moved in the close direction, the damping unit 160 slides toward the rear end of the housing 150. Here, space of a predetermined distance exists between the outer surface of the rear end 162*b* of the damper and the inner surface of the rear end 151 of the damper. Therefore, during the closing process, the shock absorption operation starts after the outer surface of the rear end 162*b* of the damper makes contact with the inner surface of the rear end 151 of the damper rather than just after the closing operation of the container starts. After making the contact, the damper rod 164*b* fastened to the shock absorption part 164*a* in the damper 162 and the connector 166 coupled to the end of the damper rod 164*b* slowly move the slider 140 in the close direction by means of the restoring force of the elastic body 170.

By virtue of the damping unit 160 having the above-mentioned construction, even if force greater than a predetermined range of force within which the damper 162 can be normally operated is applied to the container when the closing operation of the container starts, in other words, even if force by which the container is closed is greater than a critical load, the container can be prevented from rebounding in the open direction before the slider 140 rotates and moves in the close direction.

That is, in the present invention, when the shock absorption operation starts after the slider 140 has been rotated and released from the receiving space 136, the slider 140 is pulled by the restoring force of the elastic body 170 provided between the housing 150 and the slider 140. Therefore, the container is moved only in the close direction.

Meanwhile, the sliding movement of the container in the open or close direction is repeated as needed by the user. When the opening operation is conducted, the container along with the movable rail 120 slides in the open direction. Simultaneously, the locking member 122 provided on the movable rail 120 moves the slider 140 while being disposed in the locking depression 143 of the slider 140.

During this process, the damping member 164 is moved in the open direction by the connector 166 disposed in the connector locking depression 141*a* of the slider 140. Here, the frictional force between the damper 162 and the damping member 164 is smaller than the frictional force between the damper 162 and the housing 150. Thus, the damper 162 is first moved in the housing 150 in the open direction. After the damper 162 comes into close contact with a portion of the body 130, the damping member 164 is moved in the open direction.

As described above, in the automatic closing apparatus 100 according to the present invention having the above-mentioned construction, the damper 162 is inserted rearward into the housing 150 coupled to the end of the body 130. During the closing operation of the container, when the outer surface of the rear end 162*b* of the damper makes contact with the inner surface of the rear end 151 of the damper, the damper 162 starts the shock absorption operation. Therefore, while the container is moved in the close direction, the container or objects stored in the container can be prevented from being deformed or damaged by a shock generated during the closing operation of the container. Even if force by which the container is closed is equal to or larger than the critical load, the container can be prevented from rebounding in the open direction.

Although the embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. An automatic closing apparatus for a sliding apparatus comprising a fixed rail fastened to a main body, a movable rail slidably installed on the fixed rail so that a container is opened or closed, and the automatic closing apparatus provided on a predetermined portion of the fixed rail, the automatic closing apparatus comprising:

a body provided on the predetermined portion of the fixed rail, with an actuating space formed in the body to be open on upper and lower ends thereof, the body comprising:

a guide wall provided in the actuating space, the guide wall including a curved guide part and a linear guide part; and a receiving space formed adjacent to the curved guide part;

a slider configured to be locked to or unlocked from a locking member of the movable rail, the slider sliding in an open or close direction under guide of the guide wall;

a hollow housing coupled to a predetermined portion of the body;

a damping unit installed in the housing; and an elastic body fastened at a first end thereof to the housing and fastened at a second end thereof to the slider, wherein the damping unit comprises:

a damper inserted into the housing rearward and provided so as to slidable within a predetermined range in the housing, the damper having therein a hollow containing space having a predetermined size; and a damping member comprising:

a shock absorption part provided in the damper so as to be slidable in a longitudinal direction of the damper; and a damper rod fastened at an end thereof to the shock absorption part and extending in the longitudinal direction, the damper rod being configured such that as the shock absorption part slides, the damper rod is extended from and retracted into the damper, wherein during a process of closing the container, when an outer surface of a rear end of the damper comes into contact with an inner surface of a rear end of the housing, the damping unit begins to absorb shock so that the container is slowly moved in a close direction by restoring force of the elastic body.

2. The automatic closing apparatus of claim 1, wherein the damper is configured so as to be replaceable with a damper having a different length, wherein shock absorption performance of the sliding apparatus can be adjusted by installing any one of the dampers having different lengths in the housing.

3. The automatic closing apparatus of claim 1, wherein working fluid is contained in the containing space, the working fluid comprising either gas or liquefied oil that can resist compressive force.

4. The automatic closing apparatus of claim 1, wherein the damping unit further comprises a connector hinged to an end of the damper rod so as to be rotatable with a predetermined radius.

5. The automatic closing apparatus of claim 1, wherein a frictional force between the damper and the housing is less than a frictional force between the damper and the damping member.

* * * * *